US009751601B2

(12) United States Patent
DeBruyn

(10) Patent No.: US 9,751,601 B2
(45) Date of Patent: Sep. 5, 2017

(54) UNDERWATER VIEWING DEVICE

(71) Applicant: Richard DeBruyn, Calgary (CA)

(72) Inventor: Richard DeBruyn, Calgary (CA)

( * ) Notice: Subject to any disclaimer, the term of this patent is extended or adjusted under 35 U.S.C. 154(b) by 0 days.

(21) Appl. No.: 14/052,110

(22) Filed: Oct. 11, 2013

(65) Prior Publication Data

US 2014/0227921 A1 Aug. 14, 2014

Related U.S. Application Data

(60) Provisional application No. 61/764,061, filed on Feb. 13, 2013.

(51) Int. Cl.
*B63C 11/49* (2006.01)
*B63B 35/79* (2006.01)

(52) U.S. Cl.
CPC ..... *B63C 11/49* (2013.01); *B63B 35/7943* (2013.01); *B63B 2035/7903* (2013.01)

(58) Field of Classification Search
CPC ..... B63C 11/49
USPC ..... 441/135, 79; 114/315; 440/54
See application file for complete search history.

(56) References Cited

U.S. PATENT DOCUMENTS

| | | | | |
|---|---|---|---|---|
| 2,712,139 | A | 7/1955 | Kelly | |
| 2,717,399 | A | 9/1955 | Backhouse | |
| 2,959,794 | A | 11/1960 | Souleles | |
| 3,085,356 | A | 4/1963 | Wayfield | |
| 4,691,658 | A | 9/1987 | New | |
| 4,723,329 | A | 2/1988 | Vaccaro | |
| 4,844,595 | A | 7/1989 | Nealy | |
| 4,895,539 | A | 1/1990 | Bender | |
| 5,399,111 | A * | 3/1995 | Kobayashi et al. | 440/6 |
| 5,685,753 | A | 11/1997 | Canela | |
| 5,836,794 | A * | 11/1998 | Krueger | 440/54 |
| 6,142,844 | A * | 11/2000 | Klauber | 441/129 |
| 7,416,461 | B2 | 8/2008 | Yeh | |
| 7,430,795 | B2 | 10/2008 | Lin | |
| 2006/0252318 | A1 | 11/2006 | Krantz | |
| 2013/0280974 | A1 * | 10/2013 | Mulvihill | 441/135 |

* cited by examiner

*Primary Examiner* — Stephen Avila
(74) *Attorney, Agent, or Firm* — Intellectual Property Law Group LLP

(57) ABSTRACT

The present invention provides for a novel floatation device useful for use by a snorkeler.

11 Claims, 3 Drawing Sheets

UNDERWATER VIEWING DEVICE

FIELD OF THE INVENTION

The present invention pertains to the field of accessories for swimmers and more accurately a buoyant device for supporting a person in a prone position.

BACKGROUND OF THE INVENTION

All of the publications, patents and patent applications cited within this application are herein incorporated by reference in their entirety to the same extent as if the disclosure of each individual publication, patent application or patent was specifically and individually indicated to be incorporated by reference in its entirety.

DESCRIPTION OF RELATED ART

Snorkeling is an activity in which a person's face is submerged in an aquatic environment usually, using a tube (snorkel) protruding above the surface of the water providing for continued breathing. The addition of a mask covering the eyes and nose of the participant enhances the experience. It is a very popular sporting activity allowing the exploration of the aquatic environment below the surface which allows the viewing of aquatic flora, fauna and underwater formations. Snorkeling is often inaccessible for those with reduced physical capacity, physical endurance; or a disease and disorder that interferes with a person's ability to swim and/or float on the surface of the water, or to maintain their head near or above the water surface.

Further, snorkeling is an activity that requires stamina, particularly for extended undertakings, due to the need to swim to change, or in many situations to maintain, one's positioning. Thus, even without physical disabilities, a person's snorkeling time may be reduced simply from exhaustion; particularly for novices to the sport.

Thus there is a need for a device which may be used as a platform for use by snorkelers which reduces fatigue, assists in maneuvering and or maintaining of the snorkeler's position, and which can enable persons to participate in snorkeling which would otherwise be unable due to physical disabilities or capacity.

SUMMARY OF THE INVENTION

The present invention provides for a floatation device comprising an elongated, substantially planar buoyant board capable of supporting a human body in a prone position substantially above water with an aperture extending through the human supporting surface to the under surface, said aperture capable of receiving a human head wearing a snorkel and mask and allowing access to the water below; said buoyant board having indentations in the longitudinal edge to receive the shoulders and arms of a human body in a prone position accessing said aperture; wherein a controllable propulsion device is mounted on the surface opposing the human supporting surface, said controllable propulsion device within reach of a human body in a prone position accessing said aperture. In one embodiment, said propulsion device is swivel mounted so as to have rotational freedom on at least one planar axis with said rotational freedom on at least one planar axis having at least 270 rotational degrees of freedom. In another embodiment the floatation device has a stabilizing fin on the under surface. In a further embodiment the floatation device has a pair of attachment points on the front and rear upper surfaces used for tethering together multiple devices of the present invention.

DETAILED DESCRIPTION OF THE PRESENT INVENTION

Methods of manufacture and compositions of materials capable of forming flotation devices useful for the present invention are well known in the art. It is contemplated that any material or composition that is suitable for supporting a human user in a prostate position substantially above water, either sea or fresh, would be useful in the present invention. Such methods of manufacture and compositions of materials include, but are not limited, to those taught in U.S. Pat. Nos. 7,172,481; 7,160,164; 7,083,486; 5,882,776; 5,658,179; and 4,836,814. In a preferred embodiment the present invention uses expanded polystyrene foam, epoxy, and fiberglass, in a composite sandwich for performance and durability; as is generally commercially available and as utilized for construction of paddle boards.

Figure 1:
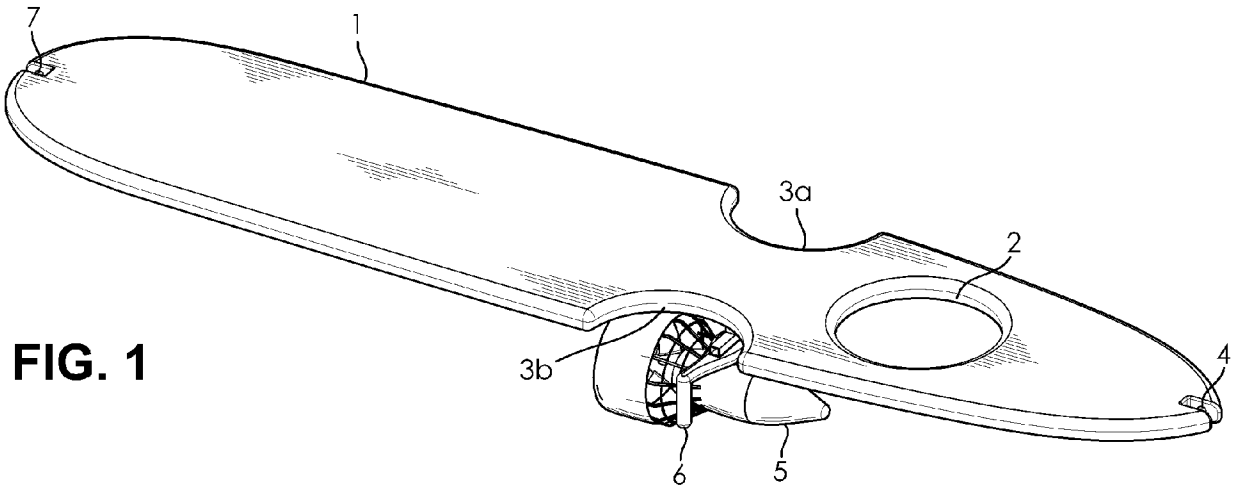
FIG. 1 shows a perspective view from the front upper quarter of a device in accordance with the present invention.

As is presented in FIG. 1, the present invention comprises an elongated buoyant device 1 of the general size, shape and composition of those articles commercially available and described as "paddle boards". It is contemplated that the overall length of the elongated buoyant device 1 be according to the size of the user and their preference. For example, children may prefer a board of substantially shorter overall length, or certain users may wish to have portions of their legs trailing off of the elongated buoyant device and submerged, or partially submerged, in the water. In a preferred embodiment the elongated buoyant device has a length along its longitudinal axis of 126 inches, a width of 29.5 inches, and a substantially planar top and bottom surface unless otherwise described herein.

Positioned within elongated buoyant device 1 is aperture 2, of size and dimension allowing the positioning of a human head wearing snorkel and mask within it, providing access through the elongated buoyant device 1 to the water underneath. As presented in FIG. 1, the aperture is generally circular, though it is contemplated by the present invention that said aperture may be other shapes, so long as allowing access of at least a mask into the water underneath. Due to the thickness of material required to maintain buoyancy of adult users on said elongated buoyant device, apertures capable of receiving only a mask may be insufficient to allow the placing of the mask in contact with, or partially submerged, with the water underneath. It is therefore contemplated that elongated buoyant devices composed of expanded polystyrene and designed to maintain buoyancy with humans weighing up to 200 pounds, have an aperture large enough to allow the passage of the entire head, complete with mask and snorkel. In a preferred embodiment said aperture is circular with a diameter of 18 inches and placed such that the center of aperture 2 is 41 inches from the leading edge of elongated buoyant device 1. For elongated buoyant devices composed of expanded polystyrene and designed to maintain buoyancy with humans weighing less than 75 pounds, apertures of reduced size, capable of receiving only a mask, are possible due to the reduced thickness of the elongated buoyant device.

Positioned behind said aperture, relative to the leading edge of elongated buoyant device, are paired indentations 3*a* and 3*b*. Paired indentations 3*a* and 3*b* are intended to receive the shoulders of a user in a prone position with said user's head positioned within aperture 2. In a preferred embodiment the paired indentations 3*a* and 3*b* are positioned such that the leading edge of the paired indentations are 4 inches distal from the trailing edge of aperture 2; and in the preferred embodiment the leading edge of indentations 3*a* and 3*b* are 54 inches from the leading edge of the elongated buoyant device as measured along its longitudinal axis. Indentations 3*a* and 3*b* are pictured as semicircular which provides utility and access for the arms of a wide range of users of differing heights and weights, though other shapes are contemplated by the present invention. In a preferred embodiment the depth of indentations 3*a* and 3*b*, as measured from the longitudinal axis of the elongated buoyant device to the nearest edge of the indentation to said axis, be no more than 7.5 inches for boards intended for adult users. Lesser distances between the nearest edge of the indentations to the longitudinal axis of the elongated buoyant device, which correspond to increased depth of indentations, are possible, particularly for users of lesser height and weight, though consideration of overall integrity of the device must be had.

Figure 2:
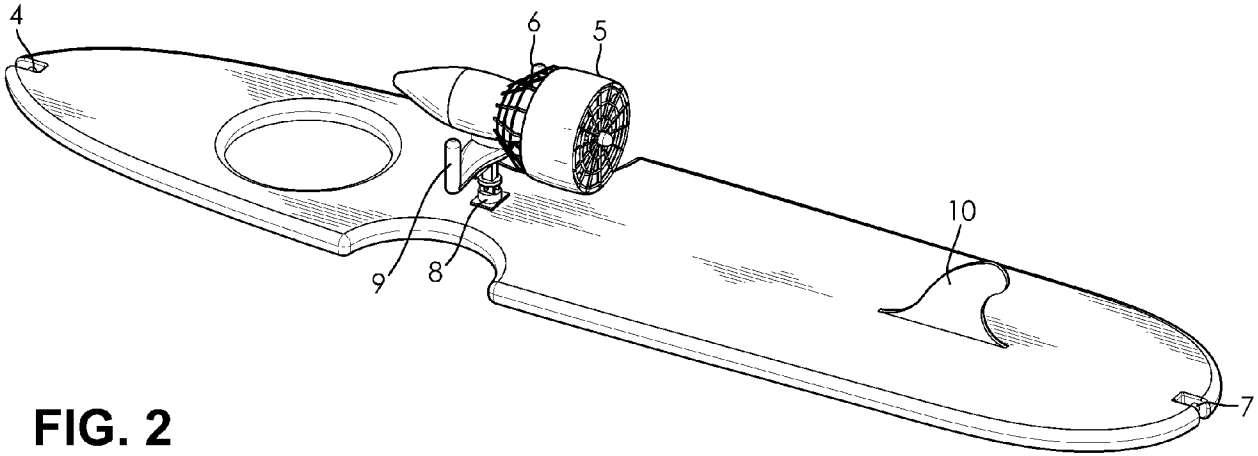
FIG. 2 shows a perspective view from the rear lower quarter of a device in accordance with the present invention.

As shown partially in FIG. 1 and in more detail FIG. 2, is propulsion device 5. Mounted to the side opposing that which the user lays in a prone position, propulsion device 5 is in mechanical communication with handles 6 and 9. Mount 8 attaches the propulsion device to elongated buoyant device 1, and the mount may be selected from any number of commercially available mounts, generally known in the art. It is contemplated by the present invention that said mount provides rotational freedom for said propulsion device 5, and in a preferred embodiment the mount provides 360 degrees of rotational freedom about an axis perpendicular to the planar surface upon which the user lies prone. In a preferred embodiment handles 6 and 9 are in direct mechanical communication with the propulsion device 5, which allows the user, when laying in a prone position, the ability to grasp handles 6 and 9 and provides the user the capability to direct the present invention to areas of interest within the aquatic environment, or to assist in the maintenance of position against wind, wave or current forces applied against the invention.

Figure 3:
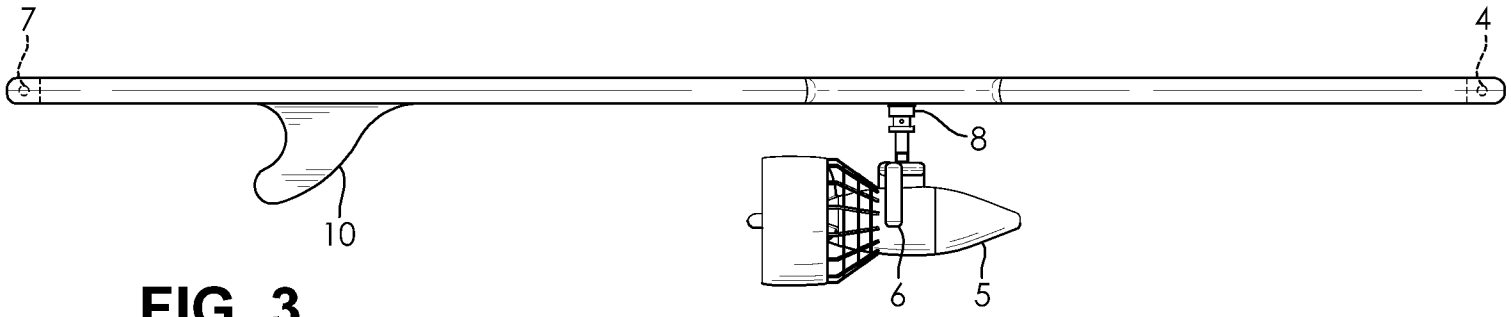
FIG. 3 shows a side view of the device in accordance with the present invention.
Figure 4:
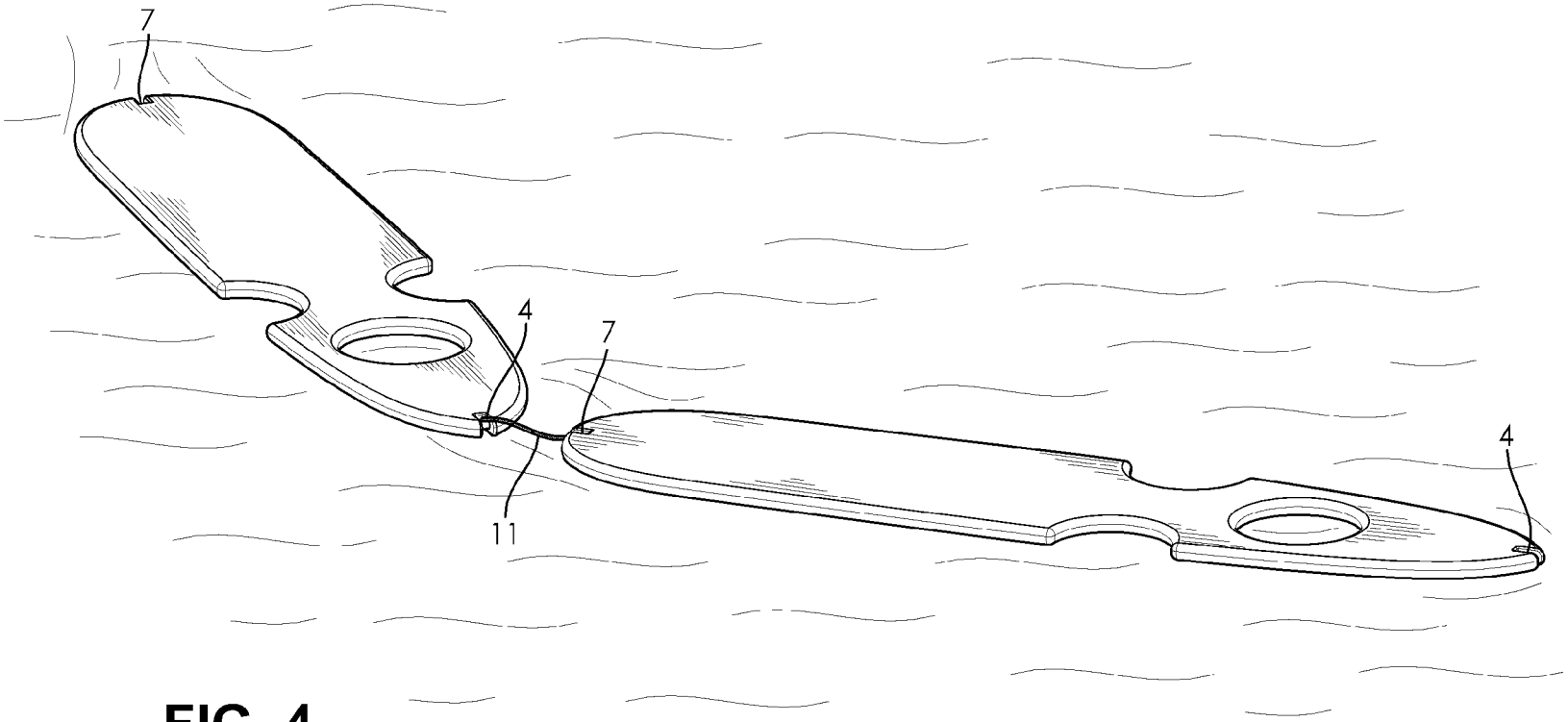
FIG. 4 shows a perspective view of a pair of tethered devices in accordance with the present invention.

FIG. 3 provides a side profile of the present invention, displaying optional stabilizing fin 10. FIG. 3 also shows optional attachment points 4 and 7 which allow users to tether additional devices to each other enabling multiple users to remain in proximity with each other. Many attachment points are known in the art, though in a preferred embodiment of the present invention, the attachment points are formed by a small notch removed from each of the front and rear of the elongated board, through which a small metal bar spans across the notch, said bar being embedded into said elongated board. Such tethering is shown in FIG. 4, in which attachment points 4 and 7 are used to tether two devices together using bungee cord 11.

While particular embodiments of the present invention have been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiments. The invention is therefore to be considered limited solely by the scope of the appended claims.

What is claimed is:

1. A floatation device comprising an elongated, substantially planar buoyant board capable of supporting a human body in a prone position substantially above water with an aperture extending through the human supporting surface to the under surface, said aperture capable of receiving a human head wearing a snorkel and mask and allowing access to the water below; said buoyant board having indentations in the longitudinal edge, to receive the shoulders and arms of a human body in a prone position accessing said aperture, a leading edge of each of the indentations positioned behind a trailing edge of the aperture; wherein a controllable propulsion device entirely submerged during its operation is mounted on the surface opposing the human supporting surface, said controllable propulsion device within reach of a human body in a prone position accessing said aperture.

2. The floatation device of claim 1 wherein said propulsion device is swivel mounted so as to have rotational freedom on at least one planar axis.

3. The floatation device of claim 2 wherein said rotational freedom on at least one planar axis is at least 180 degrees.

4. The floatation device of claim 2 wherein said rotational freedom on at least one planar axis is at least 270 degrees.

5. The floatation device of claim 1 wherein there is a stabilizing fin on the under surface of said device.

6. The floatation device of claim 2 wherein said device presents a pair of attachment points on the front and rear upper surfaces.

7. The floatation device of claim 1 wherein an upper surface of the buoyant board is a substantially mirror image of an under surface of the buoyant board.

8. The floatation device of claim 1 wherein an axial plane at which the aperture begins on an upper surface of the buoyant board is substantially along a same plane as the upper surface of the buoyant board surrounding the aperture.

9. The floatation device of claim 1 wherein an axial plane at which the aperture ends on an under surface of the buoyant board is substantially along a same plane as the under surface of the buoyant board surrounding the aperture.

10. The floatation device of claim 1, further comprising a pair of handles in mechanical communication with the propulsion device, the pair of handles located beneath the surface opposing the human supporting surface.

11. A floatation device comprising an elongated, substantially planar buoyant board capable of supporting a human body in a prone position substantially above water with an aperture extending through the human supporting surface to the under surface, said aperture configured to receive a human head wearing a snorkel and mask through said aperture and allowing access for the human head wearing the snorkel and mask to the water below while the human body is in the prone position;

said buoyant board having indentations in the longitudinal edge, to receive the shoulders and arms of a human body in a prone position accessing said aperture, the indentations providing access for the shoulders and arms of the human body to contact the water while the human body is in the prone position; wherein a controllable propulsion device is mounted on the under surface of the board, said controllable propulsion device comprising a handle beneath the under surface of the board within reach of the human body, via said indentations, in a prone position accessing said aperture.

* * * * *